US005964607A

United States Patent [19]

Finke et al.

[11] Patent Number: 5,964,607

[45] Date of Patent: Oct. 12, 1999

[54] COAXIAL SWITCHING JACK WITH SLIDING CENTER CONDUCTOR

[75] Inventors: Thomas R. Finke, Medina; John D. Schmidt, Burnsville; Ahmad Sajadi, Eagan, all of Minn.

[73] Assignee: ADC Telecommunications, Inc., Minnetonka, Minn.

[21] Appl. No.: 08/835,116

[22] Filed: Apr. 4, 1997

[51] Int. Cl.[6] ..... H01R 29/00

[52] U.S. Cl. ..... 439/188; 439/944

[58] Field of Search ..... 439/188, 510, 439/513, 516, 650, 944

[56] References Cited

U.S. PATENT DOCUMENTS

| | | | |
|---|---|---|---|
| 3,873,785 | 3/1975 | Lieberman | 439/944 |
| 4,749,968 | 6/1988 | Burroughs | 333/124 |
| 4,952,174 | 8/1990 | Sucht et al. | 439/584 |
| 5,246,378 | 9/1993 | Seiceanu | 439/188 |
| 5,348,491 | 9/1994 | Louwagie et al. | 439/188 |
| 5,467,062 | 11/1995 | Burroughs | 333/124 |
| 5,562,464 | 10/1996 | Lecourtois | 439/188 |
| 5,626,485 | 5/1997 | Clyatt, III et al. | 439/188 |
| 5,702,262 | 12/1997 | Brown et al. | 439/188 |
| 5,775,927 | 7/1998 | Wides | 439/188 |

FOREIGN PATENT DOCUMENTS

| | | | |
|---|---|---|---|
| 0 577 277 A1 | 1/1994 | European Pat. Off. . | |
| 90 03 258 | 7/1990 | Germany | H01R 17/12 |
| 2 263 591 | 7/1993 | United Kingdom | H01R 17/12 |
| WO 95/13637 | 5/1995 | WIPO | H01R 17/12 |

OTHER PUBLICATIONS

Product literature of Canare Company referencing a VWJ2–W and VWJ2–S switching coaxial jack and explanatory sketches dated Dec. 28,1995 and Jan. 4, 1996 as described be declaration.

P. 84 from a publication of ADC Telecommunications, Inc. entitled *Communication Connecdtors*, published Dec., 1993.

*Primary Examiner*—Khiem Nguyen
*Attorney, Agent, or Firm*—Merchant & Gould P.C.

[57] ABSTRACT

A switching coaxial jack module includes two center conductors contained within a housing. The center conductors include front and rear portions which are axially movable relative to one another between connect and disconnect positions. In the connect position, the front portions are electrically connected to the rear portions. In the disconnect position, the front portions are electrically disconnected from the rear portions. A switch mechanism is contained within the interior to electrically connect the rear portions when both of the front portions are in the disconnect position and to electrically disconnect the rear portions when at least one of the front portions is in the connect position.

22 Claims, 5 Drawing Sheets

COAXIAL SWITCHING JACK WITH SLIDING CENTER CONDUCTOR

I. BACKGROUND OF THE INVENTION

1. Field of the Invention

This invention pertains to coaxial jacks. More particularly, this invention pertains to a switching coaxial jack which is suitable for use in high frequency transmission rate applications.

2. Description of the Prior Art

Switching coaxial jacks are well known. An example of such is shown in U. S. Pat. Nos. 4,749,968 and 5,467,062 both to Burroughs. Another example is shown in U.S. Pat. No. 5,246,378 to Seiceanu.

Prior art switching coaxial jacks included two generally solid center conductors disposed in parallel alignment in a grounded electrically conductive housing. A switching assembly is positioned between the two center conductors.

The switching assembly includes a V-shaped spring with a first end biased against a first of the center conductors and with a second end biased against a second of the center conductors. As a result, the center conductors are in normal signal flow communication such that an electrical signal on one of the center conductors passes through the switching assembly to the other center conductor.

Such switching coaxial jacks would commonly be used in the telecommunications or video transmission industries. A rear end of the housing is provided with connectors for semi-permanent or permanent connection to coaxial cables. The front end of the center conductors are provided with jack ports for receiving a plug of predetermined dimensions. Normally, such switching jacks are operated without plugs inserted within the ports. Accordingly, a signal entering a center conductor from one of the rear connectors passes through the switching assembly and is transmitted out of the jack device through the other rear coaxial connector.

From time to time it is desirable to access the jack in order to re-route the signal or to input a new signal. To accomplish this, a jack plug with attached coaxial cable is inserted into one of the forward ports. Upon insertion of the jack plug into the forward port, the jack plug engages the V-shaped spring causing it to be moved away from the center conductor associated with the port into which the plug is inserted. By causing the V-shaped spring to be moved away from the center conductor, the center conductor is no longer connected to the other center conductor such that the signal passes directly along the entire length of the center conductor and out the port. In addition to breaking the connection between the two center conductors of the jack, insertion of the plug also causes the other center conductor to be electrically connected to ground across a resistance so that the desired electrical impedance of the system is maintained.

With the structure thus described, normal signal flow from rear connector to rear connector passes through the V-shaped spring. There is a substantial length of the center conductors which extend beyond the V-shaped spring without connection to any ground or other source of connection. In the past, these free lengths of center conductors typically presented little or no problem in the telecommunications industry. However, with progressively higher transmission frequencies, the free lengths of center conductors can present distortions to signals or otherwise impair signal integrity.

Another problem associated with prior art switching coaxial jacks is admission of dust or other contaminants to the switching assembly. Such jacks typically have free airflow through the forward ports into the switching assembly of the jack.

II. SUMMARY OF THE INVENTION

According to a preferred embodiment of the present invention, a switching coaxial jack is disclosed having a housing containing first and second parallel-aligned coaxial center conductors. The center conductors have front ends exposed through ports in a forward wall of the housing to receive a center pin of a plug. Rear ends of the center conductors have associated coaxial connectors for coupling the rear ends to external conductors. Each of the center conductors includes a rear portion and a front portion. The front portions are slidably mounted within the interior for the front portion to axially slide between a connected position and a disconnected position. In the connected position, the front portions are electrically connected to the rear portions. In the disconnected position, the front portions are electrically disconnected from the rear portions. The switch mechanism is contained within the housing between the rear portions to electrically connect the rear portions when both of the front portions are in the disconnect position. The switch mechanism electrically disconnects the rear portions when at least one of the front portions is in a connect position.

III. DESCRIPTION OF THE DRAWING

IV. DESCRIPTION OF THE PREFERRED EMBODIMENT

Figure 1:
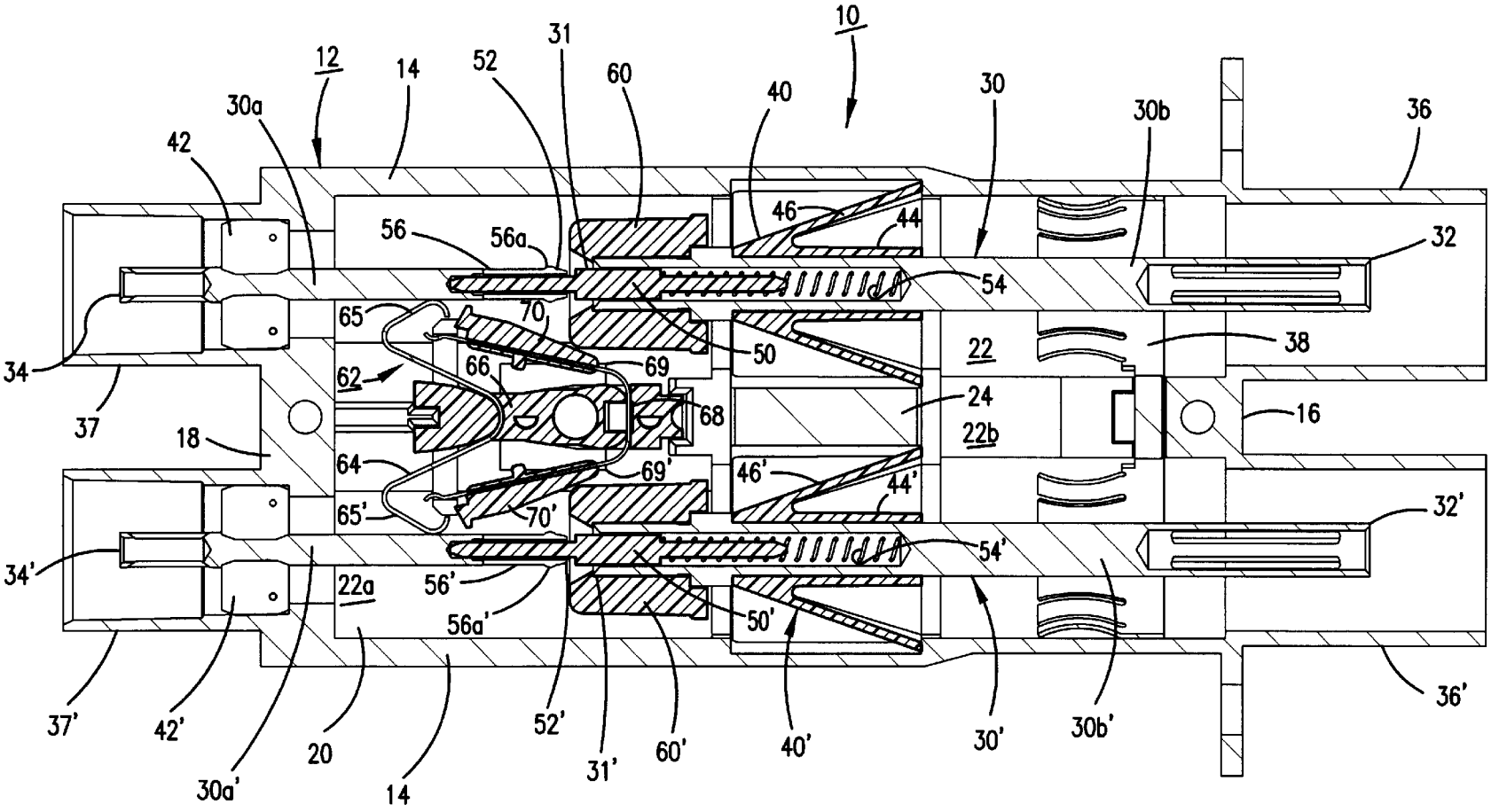
FIG. 1 is a cross-sectional view of a switching coaxial jack module according to the present invention.

A switching coaxial jack module 10 includes an electrically conductive housing 12 including side walls 14, a front wall 16, and a rear wall 18. The walls, 14, 16, 18 cooperate with a bottom wall 20 and a cover (not shown) to define a housing interior 22.

An intermediate wall 24 extends within the interior 22 between the side walls 14. The wall 24 is parallel to and positioned between the front wall 16 and rear wall 18 to divide the interior 22 into a rear chamber 22*a* and a front chamber 22*b*.

The housing contains first and second coaxial center conductors 30, 30', each extending from a front end 32, 32' to a rear end 34, 34'. The center conductors 30, 30' are mounted within the interior 22 in parallel, spaced-apart alignment.

The front wall 16 includes two ports 36, 36' to receive a telecommunication plug 100 (shown only schematically in FIG. 2) having a center pin 104 surrounded by a sleeve 102. The ports 36, 36' are positioned for the center pin 104 of an inserted plug 100 to be electrically coupled with the open front ends 32, 32' of the center conductors 30, 30'. A ground clip 38 is contained within the front chamber 22*b* to slidably connect with an outer sleeve 102 of a plug inserted within either of ports 36, 36' in order to connect the outer sleeve 102 to an electrical ground. The interior surfaces of the housing 12 surrounding the center conductors 30, 30' provide a ground shield surrounding the electrically conductive center conductors 30, 30'.

Each of the center conductors 30, 30' includes a rear portion 30*a*, 30*a'* and a forward portion 30*b*, 30*b'*. The front portions 30*b*, 30*b'* are slidably mounted within the interior 22 to move axially relative to the rear portions 30*a*, 30*a'* between connected positions and disconnected positions.

In FIG. 1, both of the front portions 30*b*, 30*b'* are shown in the disconnected positions spaced from the rear portions 30*a*, 30*a'*. In the connected positions (show only with respect to front portion 30*b* in FIG. 2), the front portions 30*b*, 30*b'* are slidably moved toward the rear portions 30*a*, 30*a'* in order to electrically connect with the rear portions 30*a*, 30*a'*.

As shown in the figures, the rear portions 30*a*, 30*a'* are completely contained within the rear chamber 22*a*. The front portions 30*b*, 30*b'* are contained within the front chamber 22*b* with rear connecting ends 31, 31' extending into the rear chamber 22*a*.

The front portions 30*b*, 30*b'* pass through the interior wall 24 and are slidably supported within the interior wall by sealing dielectric supports 40, 40'. The rear portions 30*a*, 30*a'* are supported within the chamber 22*a* by dielectric supports 42, 42'.

The dielectric supports 40, 40' have central hubs 44, 44' which slidably receive the forward portions 30*b*, 30*b'* to maintain the forward portions 30*b*, 30*b'* in sliding and coaxial alignment with the stationary rear portions 30*a*, 30*a'*. The supports 40, 40' include conical walls 46,46' which are snugly received against walls 14, 24 to hold the supports 40, 40' in a stationary position. The conical walls 46, 46' present a closed radial surface perpendicular to the axis of the center conductors 30, 30' to resist dust migration from the front chamber 22*b* to the rear chamber 22*a*. Further, the supports 42, 42' further restrict dust migration from an exterior of the housing into the rear chamber 22*a*. As a result, the rear chamber 22*a* is substantially sealed from dust migration from an exterior of the housing 12 into rear chamber 22*a*.

In addition to providing a resistance to dust flow, the conical walls 46, 46' also reduce signal back reflection since the supports 40, 40' do not present substantial areas of surface of dielectric material perpendicular to the axis of the center conductors 30, 30'. The avoidance of such perpendicular surfaces reduces undesirable back reflection of a signal carried on the center conductors 30, 30'.

Each of the rear portions 30*a*, 30*a'* contains an axially extending dielectric spring support pin 50, 50' on a front connecting end 52, 52' of the rear portions 30*a*, 30*a'*. The pins 50, 50' extend into the rear connecting portions 31, 31' of the center conductor front portions 30*b*, 30*b'*.

First and second springs 54, 54' are carried on each of the pins 50, 50' and abut against internal surfaces of the front portions 30*b*, 30*b'*. Accordingly, the springs 54, 54' urge each of the front portions 30*b*, 30*b'* away from the connect position to the disconnect position shown in the figure.

The rear connecting portions 31, 31' include internal cylindrical surfaces. The external surface of the front connecting ends 52, 52' are provided with cantilevered tabs 56, 56' having enlarged-diameter areas 56*a*, 56*a'* with a rest diameter greater than the interior diameter of ends 31, 31'. Accordingly, as the forward portions 30*b*, 30*b'* are moved to the connect position, the ends 31, 31' slide over the ends 52, 52' and engage the tabs 56 in electrical and mechanical contact. The tabs 56, 56' are spaced from the pins 50, 50' to permit the tabs 56, 56' to deflect radially inwardly. The rear connecting ends 31, 31' also carry insulating cams 60, 60' for purposes that will be described.

A switch mechanism 62 is contained within the rear chamber 22*a*. Switch mechanism 62 includes a main spring 64 supported in a dielectric support block 66. The main spring 64 has a first end 65 and a second end 65'. First end 65 is biased into electrical contact with rear portion 30*a*. Similarly, second end 65' is biased into electrical contact with end rear portion 30*a'*.

Switch mechanism 62 further includes a termination spring 68 supported in the support block 66 and connected across a resistor (not shown) to ground. The termination spring 68 includes a first spring arm 69 and a second spring arm 69'. The spring arms 69, 69' are spaced from the first and second ends 65, 65' of the main spring 64. Each of the arms 69, 69' carries dielectric cam surfaces 70, 70'.

With the arrangement shown, as a plug 100 is inserted into either of ports 36, 36', the center pin 104 of the plug is received within the front end 32, 32' of the center conductor 30, 30'. Such insertion causes the forward portion 30*b*, 30*b'* to move rearwardly and to the connect position. As the front portion 30*b*, 30*b'* is moved rearwardly, the cam 60, 60' engages the cam surface 70, 70'. Such an engagement urges the spring arm 69, 69' to electrically contact the first and second spring ends 65, 65' and urge the spring ends 65, 65' away from the rear portions 30*a*, 30*a'*.

When no plug 100 is received within either of ports 36, 36', the rear portions 30*a*, 30*a'* are electrically connected across main spring 64. However, insertion of a plug 100 into either of ports 36, 36' causes the termination spring 68 to urge the main spring 64 out of contact with the associated rear portion of the center conductor and causes the other center conductor to be terminated across the resistance to ground. Preferably, the elements of the switching mechanism 62 are arranged such that the front portion 30*b*, 30*b'* is moved into electrical connection with the rear portion 30*a*, 30*a'* before the main spring is moved away from the rear portion 30*a*, 30*a'*. Such a sequence of operation is referred to as a "make-before-break" switch.

Figure 2:
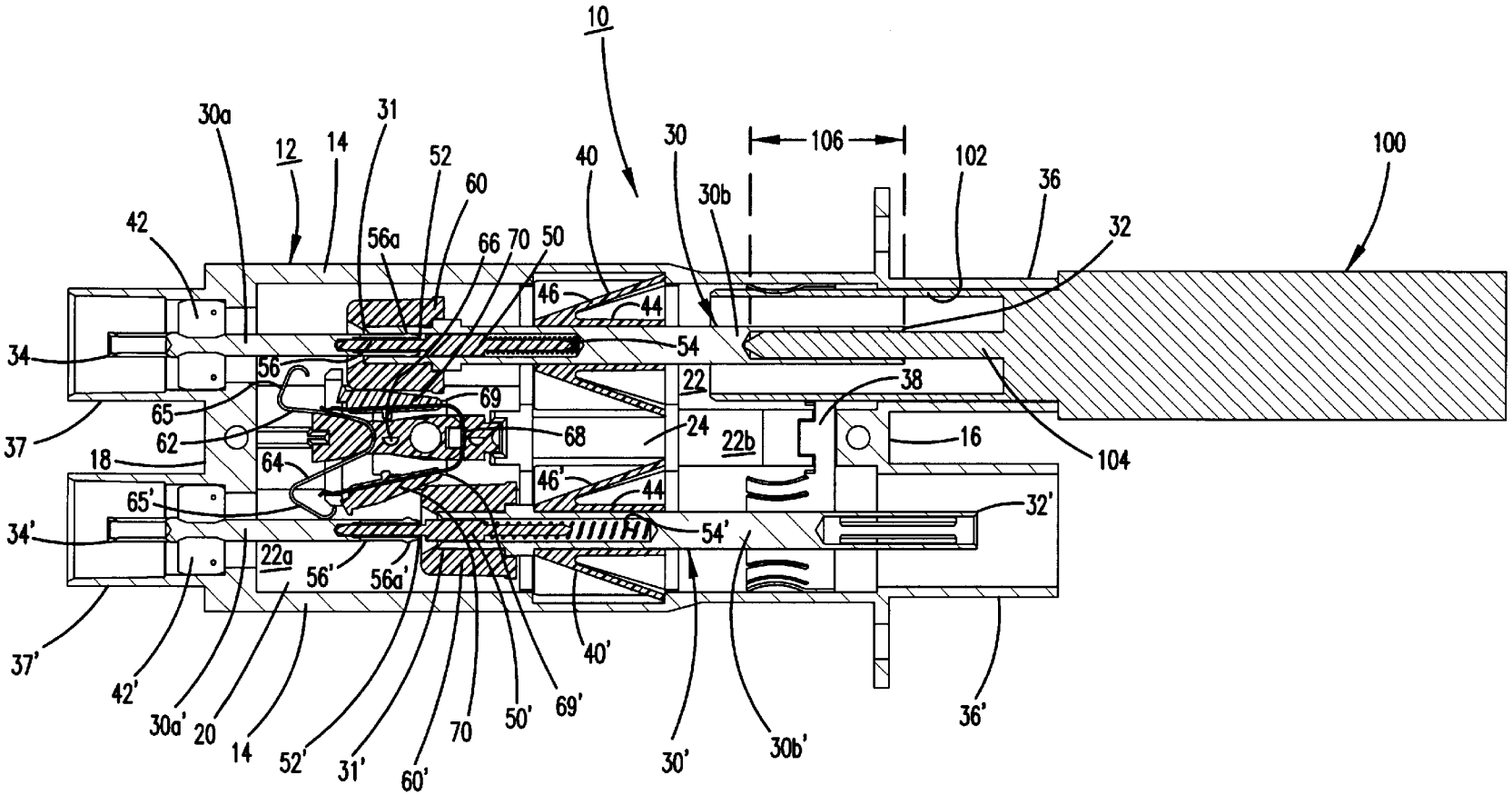
FIG. 2 is the view of FIG. 1 showing insertion of a plug into the jack of FIG. 1.

In FIG. 2, a standard plug 100 is shown in schematic format. Such plugs commonly include a center pin 104 completely surrounded by a coaxially aligned sleeve 102. Both the sleeve and the center pin are electrically conductive. In FIG. 2, the plug 100 is shown schematically in cross-section. By schematically it is meant that the cross hatching in the figure is uniform throughout the representation of plug 100. In fact, it is recognized in the art that sleeve 102 is separated from center pin 104, such that center pin 104 is connected to a source of a signal (or a destination of a signal) while sleeve 102 is electrically connected to a ground sleeve of a coaxial cable attached to the plug 100. An air space between the sleeve 102 and the pin 104 results in the plug 100 having a characteristic impedance. As shown in FIG. 2, as the pin 104 is inserted into the open end 32 of the center conductor 30, an overlap length 106 is created where the pin 104 and center conductor 30 overlap. With the conventional jack plug 100, the overlap length 106 is completely contained within the sleeve 102 and extends partially into the area surrounded by the port 36.

The creation of the overlap area or overlap length 106 as shown in FIG. 2 using a conventional plug 100 can result in an impedance mismatch. Namely, jacks 10 may commonly have a desired characteristic impedance of 75 Ohms. Similarly, the plug 100 will have a desired characteristic impedance of 75 Ohms. Applicant has found that when a plug 100 having an inner diameter of the sleeve 102 equaling 0.328" (as is common) surrounds the 0.125" outer diameter of the center conductor 30 (with an air dielectric), an impedance of approximately 58 Ohms is generated in the overlap length 106. Similarly, the 0.125" outer diameter of the center conductor 30 when located within the port 36 (which commonly has an inner diameter of 0.381") causes an impedance of about 67 Ohms. It will be appreciated that the foregoing dimensions are representative and are given with respect to standard plugs such as a well known WECO standard plugs. Ideally, the impedance throughout the signal path should be about 75 Ohms. When the foregoing impedance mismatches occur, a certain percentage of the inputted power is reflected back to the source degrading a signal. Such a degradation is particularly troublesome when the jack 10 and plug 100 are to be used in high transmission rate applications.

Figure 5:
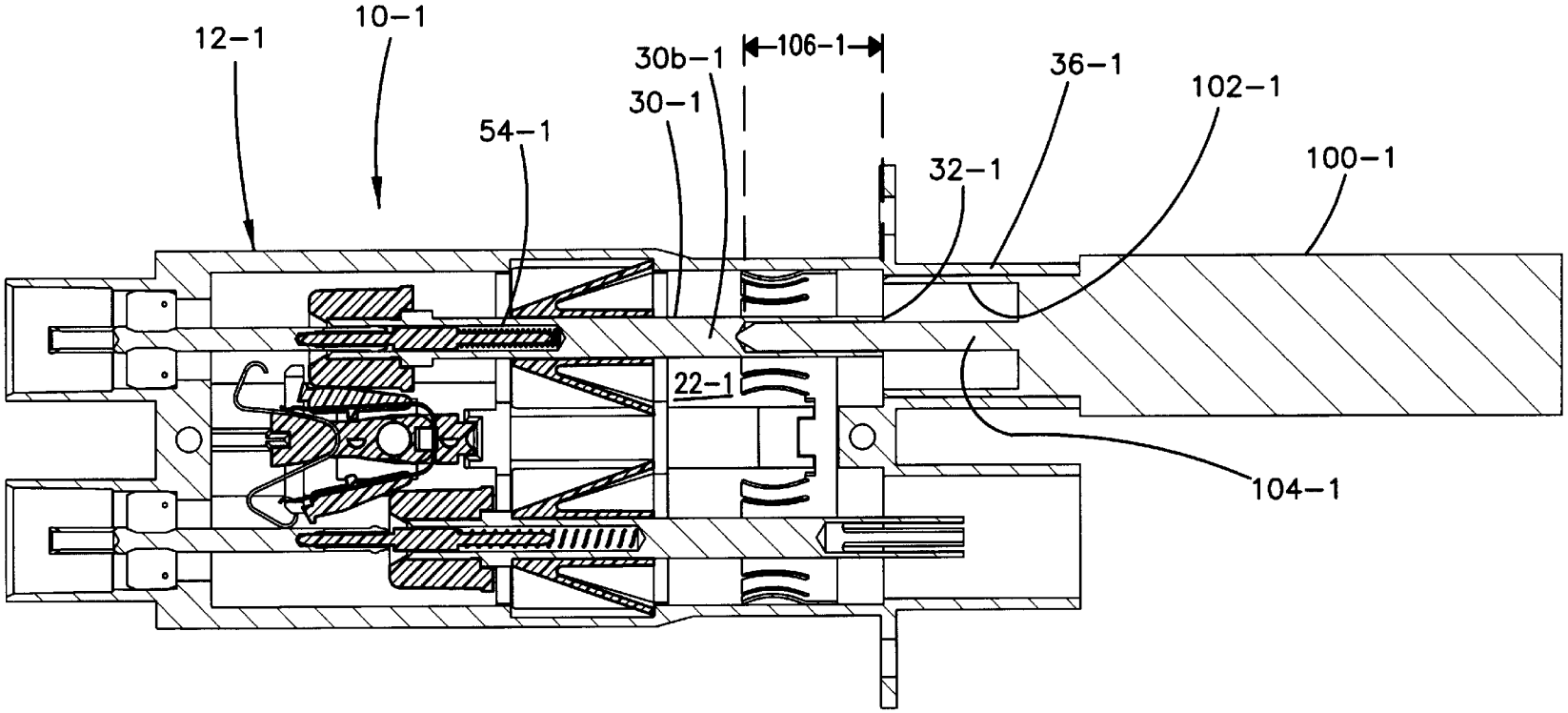
FIG. 5 is a side section view of a modified jack of FIG. 1 with a still third embodiment of an improved plug inserted within the jack.

As shown in FIG. 2, the jack 10 can be used with a conventional and standard sized plug 100. In addition, the present invention includes novel designs of the jack 10 and the plug 100 to reduce or avoid the impedance mismatch. Such a modified jack and plug are shown in FIG. 5. Elements having the same function and purpose as in FIG. 2 are numbered identically in FIG. 5 with a "–1" added to distinguish the embodiments.

As shown in FIG. 5, the jack center conductor 30-1 and the pin 104-1 of the plug 100-1 are mutually sized such that when the plug 100-1 is inserted within the port 36-1 the free end 32-1 of the center conductor 30-1 is completely recessed into the interior 22-1 of the jack 10-1 and out of the port 36-1. As a result of this sizing of elements to move the free end 32-1 out of the port 36-1 the previously mentioned impedance mismatch of a jack center conductor extending within the jack port is avoided since the jack center conductor is no longer overlapped by the jack port.

In addition to the foregoing method of avoiding the impedance mismatch, the axial length of the plug sleeve 102-1 can be reduced such that the sleeve 102-1 does not surround the overlap area 106-1. This geometry eliminates the 75 Ohm impedance mismatch described above. Any shortening of the sleeve 102-1 to prevent an extension of the sleeve 102-1 over the overlap area 106-1 is desirable in order to reduce the impedance mismatch. FIG. 5 shows a geometry where the sleeve 102-1 is shortened so that no portion of the sleeve 102-1 surrounds the overlap area 106-1.

Figure 3:
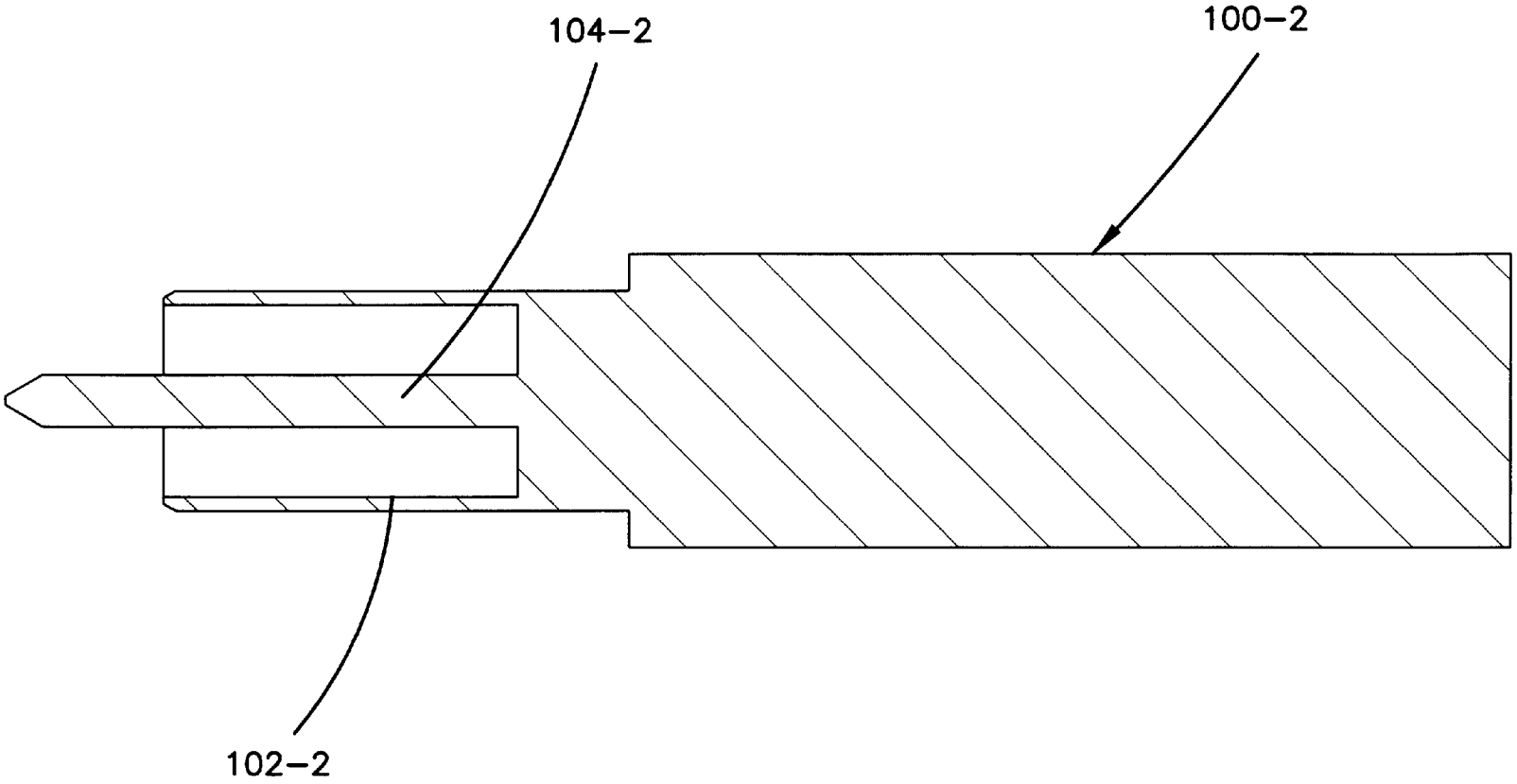
FIG. 3 is a schematic side sectional view of a novel jack plug with improved impedance matching.

FIG. 3 shows an embodiment of a plug 100-2 where the sleeve 102-2 is not shortened to the extent shown in FIG. 5 but is shortened to permit a portion of the center pin 104-2 to protrude beyond the sleeve 102-2. As a result, the length of the overlap area 106-1 surrounded by the sleeve 102-2 will be reduced resulting in a reduction of the impedance mismatch.

Figure 4:
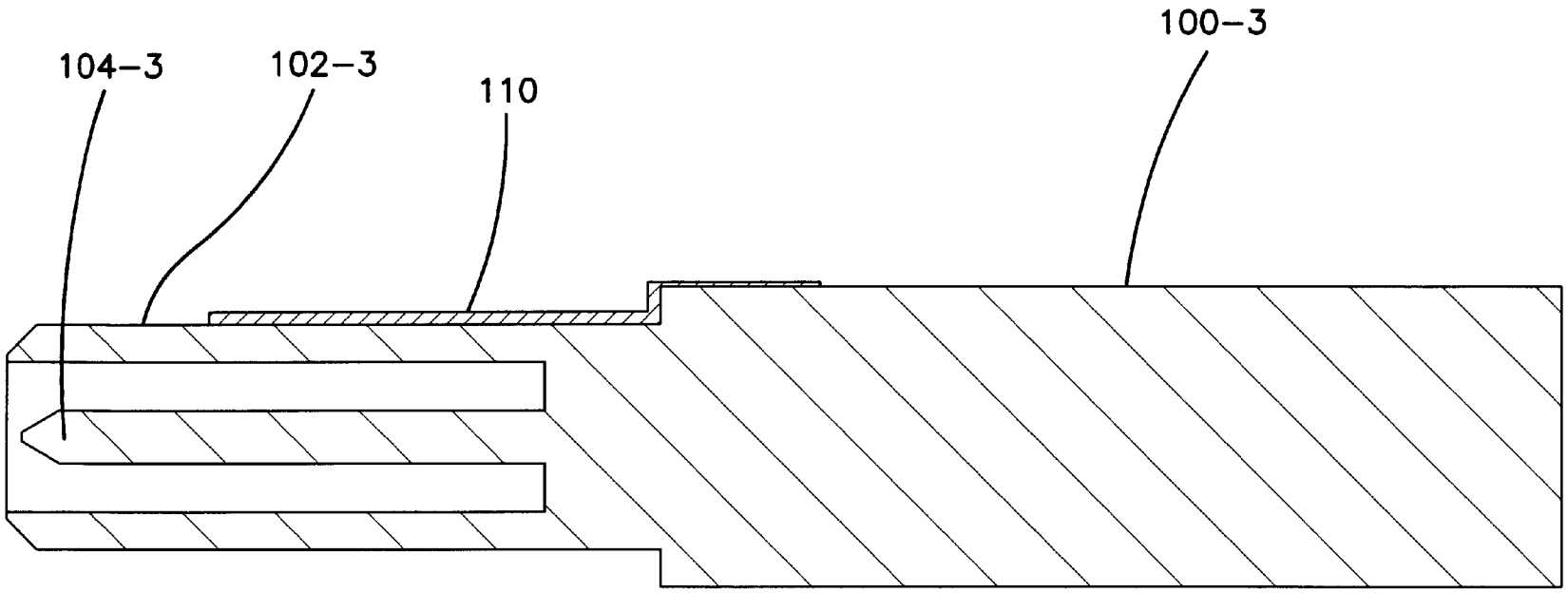
FIG. 4 is a side sectional view of an alternative embodiment of an improved plug.

FIG. 4 shows a still further embodiment of a plug 100-3 where a sleeve 102-3 completely surrounds a center pin 104-3. In the embodiment of FIG. 4, the sleeve 102-3 is formed of dielectric material so that a conductive sleeve is not surrounding the pin 104-3. A ground clip 110 is provided and schematically shown in FIG. 4 to engage the grounded surfaces of the jack 10 in order to connect the ground shelf of an attached cable (not shown) to the grounded components of the jack 10.

In summary, three modifications to the jack and associated plug are illustrate in order to reduce the undesirable impedance mismatch. The three methods are:

1. Moving the jack center conductor free end 32 out of the sleeve 36 so that no portion of the jack center conductor 30 is surrounded by the port 36 after a plug 100 is inserted within the port 36;

2. Shortening the plug sleeve 102 so that no portion of the plug sleeve 102 surrounds the center conductor 30; and 3. Molding the plug sleeve 102 of a dielectric material. The internal geometries of the dielectric material may be calculated through well known techniques to provide a desired impedance in any cross section along the length of the dielectric sleeve.

It will be appreciated that neither of the three methods need be adopted in its entirety. For example, if the free end 32 is not completely removed from the port 36 upon insertion of a plug but it is substantially moved out of the port 36, the impedance mismatch will not be eliminated but will be greatly reduced. Further, the three techniques can be used in combination. For example, with reference to FIG. 5, the free end 32-1 is shown completely removed from the port 36-1. The sleeve 102-1 is shortened so that no portion of the sleeve 102-1 surrounds the overlap area 106-1 and the sleeve 102-1 may be made of dielectric material having a geometry selected for desired impedance along an axially length of the sleeve 102-1.

From the foregoing detailed description of the present invention, it has been shown how the objects of the invention have been attained in the preferred embodiment. Modifications and equivalents of the disclosed concepts are intended to be included within the scope of the claims which are appended hereto.

What is claimed is:

1. A switching coaxial jack module comprising:

a housing having walls defining an interior;

a first coaxial center conductor and a second coaxial center conductor each disposed within said interior in parallel, spaced-apart alignment and each extending from a front end to a rear end;

said walls including a forward wall with first and second ports sized to receive a plug having a center pin to mate with said front ends exposed through said ports;

said walls including a rear wall having coaxial connectors for attachment to external coaxial conductors and electrically coupling said external conductors to individual ones of said rear ends;

each of said center conductors including a rear portion having said rear end and a separate front portion having said front end;

said front portions slidably mounted within said interior for said front portion to axially slide between a connected position with said front portions electrically connected to said rear portions and a disconnected position with said front portions electrically disconnected from said rear portions; and a switch mechanism contained within said interior to electrically connect said rear portions when both of said front portions are in said disconnect position and to electrically disconnect said rear portions when at least one of said front portions are in said connect position, said switch mechanism including a grounded contact having a predetermined resistance, wherein said rear portion of one of said center conductors is connected to said grounded contact when said one center conductor is in the disconnect position and the other of said center conductors is in the connect position.

2. A switching coaxial jack module according to claim 1 wherein:

said walls include an interior wall separating said interior into a front chamber and a rear chamber;

said rear portions and said switch mechanism completely disposed in said rear chamber;

said front portions disposed with said front ends in said front chamber and with rear connection ends of said front portion disposed in said rear chamber;

a seal for resisting particulate flow from said front chamber into said rear chamber.

3. A switching coaxial jack module according to claim 2 wherein:

said seal includes a dielectric support for slidably mounting said front portion within said interior and having a substantial closed face transverse to an axis of said center conductors.

4. A switching coaxial jack module according to claim 1 wherein:

said switch mechanism is a make-before-break switch for electrically disconnecting said rear portions after said one of said front portions is electrically connected with an associated rear portion in response to said one of said front portions moving to said connect position.

5. A switching coaxial jack module according to claim 1 comprising:

first and second springs for separately biasing said front portions of said first and second coaxial center conductors to said disconnect position.

6. A switching coaxial jack module according to claim 5 wherein:

said rear portions have front connecting ends aligned with opposing rear connecting ends of said front portions for said rear connecting ends to slide over said front connecting ends as said front portions are moved to said connect position;

said front connecting ends including radially defecting contact tabs urged radially inwardly against a bias of said contact tabs as said rear connecting ends slide over said front connecting ends;

dielectric first and second spring support pins axially extending from said front connecting ends of respective ones of said first and second rear portions, said pins spaced from said tabs by a spacing equal to a deflection of said tabs in response to an urging of said rear connecting ends;

a first end of said first and second springs secured to said pins and a second end of said first and second springs opposing said front portions with said springs compressed against a bias of said springs in response to said front ends being moved to said connect position.

7. A switching coaxial jack module according to claim 6 wherein:

said switch mechanism is a make-before-break switch for electrically disconnecting said rear portions after said one of said front portions is electrically connected with an associated rear portion in response to said one of said front portions moving to said connect position;

said switch mechanism including a main spring having first and second ends biased against said first and second rear portions and a termination spring with first and second spring arms spaced from the first and second ends of said main spring; and said rear connecting ends of said first and second front portions having first and second cams positioned to engage said first and second spring arms as said front portions are moved to said connect position with said cams urging said first and second spring arms against said first and second ends to urge said first and second ends away from said first and second rear portions.

8. A switching coax jack module according to claim 1 wherein:

said center conductors are supported within said housing with said front ends being open and exposed through said ports;

and further comprising said plug having a plug sleeve sized to be slidably received within said ports and said center pin axially aligned within said sleeve and sized to be slidably received within said open front ends as said sleeve is inserted into said ports;

said center pin and a coupled center conductor defining an overlap length of a portion of said center pin within said coupled center conductor;

said plug and said jack mutually configured for said overlap length to have an impedance substantially equal to a characteristic impedance of said jack.

9. A switching coax jack module according to claim 8 wherein said overlap portion is disposed within said housing and substantially out of said ports.

10. A switching coax jack module according to claim 8 wherein said overlap portion is disposed substantially out of said sleeve.

11. A switching coax jack module according to claim 8 wherein said sleeve is dielectric.

12. A switching coaxial jack module according to claim 5 wherein:

said switch mechanism includes a main spring having first and second ends biased against said first and second rear portions and a termination spring with first and second spring arms spaced from the first and second ends of said main spring, said termination spring forming at least a part of said grounded contact; and rear connecting ends of said first and second front portions have first and second cams positioned to activate said switch mechanism as said front portions are moved to said connect position, wherein said first and second ends and said first and second spring arms make contact, and said first and second ends are moved away from said first and second rear portions.

13. A switching coaxial jack module according to claim 12 wherein:

said switch mechanism is a make-before-break switch for electrically disconnecting said rear portions after said one of said front portions is electrically connected with an associated rear portion in response to said one of said front portions moving to said connect position.

14. A coaxial jack and plug wherein said jack has a center conductor with an open leading end, said center conductor supported within a jack housing with an axis of said center conductor coaxially aligned with a jack port and with said open leading end exposed through said port, said plug comprising:

a plug sleeve sized to be slidably received within said port;

a plug center pin axially aligned within said sleeve and sized to be slidably received within said open leading end as said sleeve is inserted into said port;

said center pin and said center conductor defining an overlap length of a portion of said center pin within said center conductor;

said plug and said jack mutually configured for said overlap length to have an impedance substantially equal to a characteristic impedance of said jack.

15. A coaxial jack and plug according to claim 14 wherein said overlap portion is disposed within said housing and substantially out of said port.

16. A coaxial jack and plug according to claim 14 wherein said overlap portion is disposed substantially out of said sleeve.

17. A coaxial jack and plug according to claim 14 wherein said sleeve is dielectric.

18. A coaxial jack and plug according to claim 15 wherein said overlap portion is disposed substantially out of said sleeve.

19. A coaxial jack and plug according to either of claims 15 or 18 wherein said sleeve is dielectric.

20. A coaxial jack and plug according to claim 16 wherein said sleeve is dielectric.

21. A switching coaxial jack module comprising:

a housing having walls defining an interior;

a first coaxial center conductor and a second coaxial center conductor each disposed within said interior in parallel, spaced-apart alignment and each extending from a front end to a rear end;

said walls including a forward wall with first and second ports sized to receive a plug having a center pin to mate with said front ends exposed through said ports;

said walls including a rear wall having coaxial connectors for attachment to external coaxial conductors and electrically coupling said external conductors to individual ones of said rear ends;

each of said center conductors including a rear portion having said rear end and a separate front portion having said front end;

said front portions slidably mounted within said interior for said front portion to axially slide between a connected position with said front portions electrically connected to said rear portions and a disconnected position with said front portions electrically disconnected from said rear portions;

first and second springs for separately biasing said front portions of said first and second coaxial center conductors to said disconnect position;

said rear portions have front connecting ends aligned with opposing rear connecting ends of said front portions for said rear connecting ends to slide over said front connecting ends as said front portions are moved to said connect position;

said front connecting ends including radially deflecting contact tabs urged radially inwardly against a bias of said contact tabs as said rear connecting ends slide over said front connecting ends;

dielectric first and second spring support pins axially extending from said front connecting ends of respective ones of said first and second rear portions, said pins spaced from said tabs by a spacing equal to a deflection of said tabs in response to an urging of said rear connecting ends;

a first end of said first and second springs secured to said pins and a second end of said first and second springs opposing said front portions with said springs compressed against a bias of said springs in response to said front ends being moved to said connect position; and a switch mechanism contained within said interior to electrically connect said rear portions when both of said front portions are in said disconnect position and to electrically disconnect said rear portions when at least one of said front portions are in said connect position.

22. A switching coaxial jack module according to claim 21 wherein:

said switch mechanism is a make-before-break switch for electrically disconnecting said rear portions after said one of said front portions is electrically connected with an associated rear portion in response to said one of said front portions moving to said connect position;

said switch mechanism including a main spring having first and second ends biased against said first and second rear portions and a termination spring with first and second spring arms spaced from the first and second ends of said main spring; and said rear connecting ends of said first and second front portions having first and second cams positioned to engage said first and second spring arms as said front portions are moved to said connect position with said cams urging said first and second spring arms against said first and second ends to urge said first and second ends away from said first and second rear portions.

* * * * *